US007322578B2

(12) United States Patent
Swartz et al.

(10) Patent No.: US 7,322,578 B2
(45) Date of Patent: Jan. 29, 2008

(54) CASINO POKER GAME

(76) Inventors: Adam Marshall Swartz, 16761 Hudson Cir., Lakeville, MN (US) 55044; Leopold Bushkin, 4A Westchester Hills, Colchester, CT (US) 06415

( * ) Notice: Subject to any disclaimer, the term of this patent is extended or adjusted under 35 U.S.C. 154(b) by 106 days.

(21) Appl. No.: 10/908,213

(22) Filed: May 2, 2005

(65) Prior Publication Data

US 2006/0244215 A1 Nov. 2, 2006

(51) Int. Cl.
*A63F 1/00* (2006.01)

(52) U.S. Cl. ..... 273/292; 273/274; 273/309; 463/13

(58) Field of Classification Search ..... 273/292, 273/274, 309; 463/13
See application file for complete search history.

(56) References Cited

U.S. PATENT DOCUMENTS

| | | | | |
|---|---|---|---|---|
| 5,752,702 | A | 5/1998 | McDoniel | 273/292 |
| 6,206,373 | B1 * | 3/2001 | Garrod | 273/292 |
| 6,379,245 | B2 | 4/2002 | De Keller | 273/274 |
| 6,651,983 | B1 | 11/2003 | Chobanian | 273/292 |
| 2001/0040345 | A1 * | 11/2001 | Au-Yeung | 273/303 |
| 2005/0082758 | A1 * | 4/2005 | Sklansky et al. | 273/292 |

* cited by examiner

*Primary Examiner*—Benjamin Layno

(57) ABSTRACT

A casino-based poker card game played with a conventional deck of cards and multiple rounds of betting, that provides each player with two face up cards and the house with two face down cards. Additionally, there are five exposed community cards that each player and the house can use in any combination of his/her two cards to form the best five-card poker hand. The player, or the house, having the highest five-card poker hand is the winner. This invention allows the house to participate in the poker game as a risk-bearing participant.

19 Claims, No Drawings

CASINO POKER GAME

1. A casino poker card game played between the house and any number of players with conventional playing cards, comprising:

(a) first, an ante round during which each player puts their first bet, a predetermined "base" amount and the house puts a pre-determined multiple of the "base" amount, into the pot;

(b) second, dealing three community cards face up, wherein each community card is usable by each player and the house to form a five card poker hand;

(c) third, conducting a round of dealing one card, face up, to each player at which time that player must either place a second bet into the pot or fold his/her hand. When it is the house's turn, its card is dealt face down. The house does not make a bet and is not allowed to fold;

(d) fourth, dealing one (the fourth) community card face up;

(e) fifth, conducting another round of dealing one card, face up, to each player at which time each player must again either wager a third bet or fold his/her hand. A portion of this third bet is put into the pot; the remainder is collected and kept by the house. When it is the house's turn, its card is dealt face down. The house does not make a bet and is not allowed to fold. {Note: A variation is described in the section labeled "DESCRIPTION OF A PREFERRED EMBODIMENT OF THE INVENTION" where the player decides whether to make the third wager (or fold) prior to the dealing of his/her second card.};

(f) sixth, dealing one (the fifth) community card face up;

(g) seventh, exposing the dealer's cards to determine which player or the house has the winning five card poker hand, wherein each hand comprises the two cards dealt to a player or the house plus the five community cards. The player or the house with the winning hand receives the pot;

said steps (a) through (g) being conducted sequentially, beginning with step (a) and concluding with step (g).

BACKGROUND AND SUMMARY OF THE INVENTION

There is in existence a poker card game known as Texas Hold Em. The game is played so that each player has the use of seven cards in order to form a five card poker hand. The player having the highest poker hand is the game winner. Hands are ranked in standard poker fashion, i.e. royal flush, straight flush, four of a kind, full house, flush, straight, three of a kind, two pair, one pair, and high card, in descending order.

In Texas Hold Em each player receives two cards face down. Additionally, there are five community cards dealt face up. The term "community card" refers to a card that is exposed (face up) and available for use by any of the players in order to form a poker hand. Each player is enabled to use seven cards (i.e. the two concealed cards that he/she holds, plus the five community cards that are available to each player).

In Texas Hold Em the cards are dealt sequentially so that each player initially receives his two cards face down, after which the five community cards are dealt face up. Rounds of betting occur at certain times during the course of the deal, usually after the two face down cards have been dealt, then after the third community card has been dealt, then after the fourth community card has been dealt, and finally after the fifth community card has been dealt. Thus, there are four rounds of betting (in addition to an ante prior to the cards being dealt.

Each player in Texas Hold Em is treated equally: dealt the same number of cards in the same manner (face down), with the same wagering amounts (i.e.: at the end of each round, either all players have the same amount of money wagered, or in the case of both a main pot and one or more side pots, all players with a potential of winning each of these pots has the same amount of money wagered for each of those pots).

There are three main distinctions that separate this Poker Game from Texas Hold Em:

{Note: The "a)" designations in the following list refer to the "Texas Hold Em" game. The b) designations refer to the current invention}

1a) When Texas Hold Em is played in a casino-setting, the house does not participate with the players as a competitor, but instead makes money only through the facilitation of the game, either through a per-hand percentage of the pot ("the rake"), an up-front percentage of the total preset tournament wagering amount ("the buy-in"), a set, per time-segment charge for the use of a table and a dealer's services, or other similar method.

1b) In this Poker Game, the house is a risk-bearing participant, is dealt the same number of card as each other participant, and has the same probability as each other participant of having the best dealt hand in each round. There are three differences in the rules between the dealer and the players:

1b (1) wagering amount—to play a hand through to the end, a player must make three separate bets whereas the house makes its entire wager at the time of the players' first bets. In addition, the total amount wagered by each player staying through the entire hand may differ from the amount wagered by the house. (The total amounts wagered by each player staying through the entire hand are the same.)

1b (2) dealt cards—cards are dealt to players face up and are immediately known to all participants, whereas cards dealt to the house are face down and not revealed until the end of the hand.

1b (3) folding—at multiple times during the course of each hand, each player has the option of betting and staying in the hand, or folding, removing himself/herself from the hand without wagering any additional amount. The house stays in every hand through to the end and cannot fold.

2a) In Texas Hold Em the amount of information available to each player before the end of the hand is limited to the community cards dealt up to that time plus his/her own face down cards.

2b) In this Poker Game, the information available to each player at any given time includes the community cards and the player's own cards dealt up to that time plus all cards dealt to other players up to that time. The only dealt cards that are unknown at any time before the end of the hand are those dealt to the house.

3a) Texas Hold Em promotes the representing of each players' relative hand strength through the betting structure. Players may misrepresent their hand strength by either over-betting a weak hand (bluffing) or under-betting a strong hand.

3b) The betting structure in this Poker Game is set for each round of betting and is based on a predetermined amount, which may be different for each round. While these predetermined amounts may vary over time, they are known prior to the beginning of each hand and cannot be changed during that hand.

The game of the present invention involves the use of seven cards by each player to form a five card poker hand. Initially, three community cards are dealt face up (each player has the use of these community cards). Then each player receives one card face up and the house receives one card face down. Then a fourth community card is dealt face up. Then each player receives a second card face up and the house receives one card face down. Lastly, a fifth community card is dealt face up.

Betting occurs during the course of the hand, e.g. a first set of simultaneous betting in the beginning of the hand before any cards have been dealt, a second set of betting immediately following the dealing of each player's first card, and a third and final set of betting either immediately following or immediately preceding each player's second card.

The present invention concerns a poker game that is in many respects similar to Texas Hold Em, but mostly differs therefrom in that players' cards that are dealt face down in Texas Hold Em are dealt face up, and the game is designed to include the house as a risk-bearing participant.

Specific features of the invention will be apparent from the attached description of a way that the game is played according to the invention.

DESCRIPTION OF A PREFERRED EMBODIMENT OF THE INVENTION

The following description explains how the game of the present invention is played. Listed are seven different events taking place sequentially during the course of the game. The description pre-supposes five players, although the game can be played by different numbers of players, from one up to about eight players (plus the house as an additional participant).

The game is played with a single deck of cards containing four suits of thirteen cards per suit, making a total of fifty-two cards. The deck is conventional poker deck (or bridge deck). The aim of each player is to achieve a winning poker hand, using two face up cards held by each player and five community cards available to all players.

For the purpose of illustration, the events described below use the following assumptions:

the "base" amount (ante bet) equal to $5, the second players' bet is equal to $5, the house's wager is equal to 3× the "base" bet ($15), the third players' bet is equal to 2× the "base" bet ($10), half of which ($5) goes to the pot, the other half ($5) to the house.

Event No. 1 is the beginning of a hand. At this point, two things take place. First, the players ante (i.e.: wager an initial bet before any cards are dealt) the "base" amount ($5) to form a pot, i.e. the prize for the winning hand. At this time, the house antes three times the "base" ($15) into the pot. In this example, at a table with five players, the initial size of the pot is $40 ($5 from each player and $15 from the house). Second, the order that each player and the house will act during Event 3 and Event 5 is decided based on a predetermined method.

Examples of this method could include, but are not limited to the following:

a random method each hand, such as by rolling a die, a sequential method, such as a clockwise progression each hand of a "dealer's chip" which keeps track of which player plays first, and a method determined by the outcome of the results of previous hand.

The order determined in Event 1 will be the same for Event 3 and Event 5.

Event No. 2 involves the dealing of three community cards face up. A community card may be used by any player in order to form a five card poker hand. For example, if Player 1 should hold one king and two of the three community cards are kings, then Player 1 has a hand value of three kings at that point in time.

Event No. 3 involves the revealing of each player's first card and the second round of betting. Based on the order decided in Event 1, one card is dealt face up to the first player (Player 1). At this time, Player 1 must decide whether he/she will fold or stay in the hand. If Player 1 folds, he/she is out of the hand, i.e.: Player 1 does not receive any more cards and has zero probability of winning the pot at the end of the hand. If Player 1 stays in the hand he/she adds the second bet ($5) to the pot.

Play continues to the player determined to go second, Player 2, as decided in Event 1, who has the same choices: to fold or stay in the hand, with the same results as with Player 1. Play continues until all players and the house have played.

There is an exception to the rules of Event 3. When it is the house's turn to play, as determined in Event 1, one card is dealt to the house face down, no decision whether or not to fold is made, and no additional money is placed by the house into the pot.

If at the end of Event 3, all players have folded, the house wins the pot and the hand is over. Events 4 through 7 are skipped.

Event No. 4 is the dealing of a fourth community card. As with the previous three community cards, the fourth community card can be any card in the deck, i.e. the topmost card in the deck at the moment.

Event No. 5 has certain features that differ between two variations:

{Both Variations}

Event No. 5 involves the revealing of each player's second card and the third (final) round of betting. Based on the order decided in Event 1, play begins with Player 1. In the event that Player 1 folded in Event 3, Player 1 is skipped and play moves to Player 2. If Player 2 has folded, play moves to Player 3 and so forth. For the sake of simplicity, assume that Player 1 did not fold during Event 2.

{Variation 1—Second Card is Revealed before Bet/Fold Decision}

One card is dealt face up to Player 1. (Player 1 now has two cards faced up.) After this time, Player 1 must decide whether he/she will fold or stay in the hand. If Player 1 folds, he/she is out of the hand, i.e.: Player 1 does not receive any more cards and has zero probability of winning the pot at the end of the hand. If Player 1 stays in the hand, he/she bets the third bet ($10). Half of this bet ($5) is added to the pot and the other half ($5) is collected and kept by the house and is not part of the pot.

{Variation 2—Bet/Fold Decision before Second Card Revealed}

Player 1 must now decide whether he/she will fold or stay in the hand. If Player 1 folds, he/she is out of the hand, i.e.: Player 1 does not receive any more cards and has zero probability of winning the pot at the end of the hand. If Player 1 stays in the hand he/she bets the third bet ($10). Half of this bet ($5) is added to the pot and the other half ($5) is collected and kept by the house and is not part of the pot. After the bet, Player 1's second card is dealt face-up.

{Both Variations}

Play continues in the order as decided in Event 1, skipping those players who folded in Event 2. Each player has the same choices to fold or stay in the hand, with the same results as with Player 1. Play continues until all players and the house have played.

There is an exception to the rules of Event 5.

When it is the house's turn to play, as determined in Event 1, one card is dealt to the house face down, no decision is made and no additional money is placed by the house into the pot.

If at the end of Event 5, all players have folded, the house wins the pot and the hand is over. Events 6 through 7 are skipped.

Event No. 6 is the dealing of a fifth community card. As with the previous four community cards, the fifth community card can be any card in the deck, i.e. the topmost card in the deck at the moment.

Event No. 7 is the determination of the hand winner. The house's two face down cards are revealed and the remaining players (i.e.: those who did not fold in Event 3 or Event 5) and the house make their best five card poker hand possible using any fives cards from the combination of their two cards and the five community cards. The player or house with the resulting highest-rank poker hand is the winner and wins the entire pot. In the event of a tie, the winners split the pot evenly.

It will be appreciated this Poker Game could be played with minor variations (in addition to the relative timing of the third bet and dealing of each player's second card dealing described above in Event 5). Examples include:

(1) removing the top card of the deck before Event 2, Event 4, and Event 6 from the game, commonly known as "burning a card";

(2) the inclusion of optional (or mandatory) side bets which may include allowing a player who folds in Event 3 to receive a card in Event 5 for the sole purpose of evaluating the side bet, (3) special payout rules for predetermined outcomes such as a superior poker hand value, or a tie where the best overall poker hand amongst the house and all players remaining through Event 7 is represented by the five community cards;

(4) partially changing the order of Event 6 and Event 7 so that the house's two face cards are revealed prior to the dealing of the fifth community card.

(5) one or more adjustments to the betting structure including, but limited to the following options:

changing the relative player and/or house wagering amounts in Event 1, Event 3, and Event 5, limiting the total number of players from whom the house takes a portion of their third bet in Event 5 (with the result being that the entire bet for the remaining players would go into the pot), including a commission provision where the house would take a portion of a player's, or, in the case of a tie, players' winning pot before payment to the winning player(s);

(6) any other minor rule change; any of which still substantially produces the same results, within the scope of our invention, as described.

What is claimed is:

1. A method of playing a casino-based poker card game, between a dealer and at least one player and played with conventional playing cards totaling fifty-two cards per deck, the method comprising the steps of:

requiring each player to place a first player bet of a first amount;

requiring the dealer to place a first dealer bet, the dealer bet being a multiple of the first amount;

requiring the dealer to deal three community cards, the three community cards being visible to the dealer and each player;

requiring the dealer to deal a first player card to each player, the first player card being visible the to the dealer and to each player;

requiring the dealer to deal a first dealer card to the dealer, the first dealer card being concealed from the dealer and each player;

requiring each player to place a second bet in order to continue participation in the card game;

requiring the dealer to deal a fourth community card face up, the fourth community card being visible to the dealer and each player;

requiring the dealer to deal a second player card to each player, the second player card being visible to each player and the dealer;

requiring each player to wager a third bet in order to continue participation in the card game;

requiring the dealer to deal a second dealer card, the second dealer card being concealed from the dealer and each player;

requiring the dealer to deal a fifth community card, the fifth community card being visible to the dealer and to each player; exposing the two dealer cards to permit determination of which of all the participants and the dealer in the card game possesses the highest ranked winning five card poker hand composed of the two cards dealt to each participant and the dealer and the five community cards; and awarding the participant or the dealer with the highest ranked winning five card poker hand a first portion of the bets placed during the card game.

2. The method of playing a card game of claim 1, wherein completion of the first dealer bet concludes all wagering activity of the dealer throughout the card game.

3. The method of playing a card game of claim 2, further comprising the step of requiring the dealer to participate in the card game until the card game is completed.

4. The method of playing a card game of claim 3, further comprising the step of awarding a predetermined portion of all of the third bets to the dealer upon completion of all of the third bets and prior to completion of the card game.

5. The method of playing a card game of claim 3, further comprising the step of awarding a predetermined portion of at least some of the third bets to the dealer upon completion of all of the third bets and prior to completion of the card game.

6. The method of playing a card game of claim 5, wherein the card game is played with a single deck of fifty two cards.

7. The method of playing a card game of claim 6, further comprising the step of requiring the dealer to determine the initial position of a "dealer's chip" which keeps track of which player plays first, the initial position being the seating position of the player to play first.

8. The method of playing a card game of claim 7, further comprising the step of requiring the dealer to deal the first and second player card to each player in a clockwise direction beginning with the player seated in front of the "dealer's chip".

9. The method of playing a card game of claim 6, further comprising the step of requiring the dealer to deal the first and second player card to each player in response to a performance by each player in a previous card game.

10. The method of playing a card game of claim 6, further comprising the step of permitting a player to wager a side bet.

11. The method of playing a card game of claim 10, further comprising the step of permitting a player who has declined to place a second bet to receive a second player card in order to evaluate a side bet.

12. The method of playing a card game of claim 6, further comprising the step of awarding the participant with the winning five card poker hand a second portion of the bets placed during the card game in response to the participant having a winning five card poker hand having a predetermined superior value.

13. The method of playing a card game of claim 6, further comprising the step of declaring a tie when the winning five card poker hand is composed solely of community cards.

14. The method of playing a card game of claim 6, further comprising the step of requiring the dealer to receive a portion of all bets before payment of a remainder of all bets to a winning player.

15. A method of playing a card game, between a dealer and as many as eight players and played with a single deck of cards that includes four suits totaling fifty-two cards, the method comprising the steps of;

requiring each player to place a first player bet of a first amount;

requiring the dealer to place a first dealer bet, the dealer bet being a multiple of the first amount;

requiring the dealer to deal three community cards, the three community cards being visible to the dealer and each player;

requiring the dealer to deal a first player card to each player, the first player card being visible to the dealer and to each player;

requiring the dealer to deal a first dealer card to the dealer, the first dealer card being concealed from the dealer and each player;

requiring each player to place a second bet in order to continue participation in the card game;

requiring the dealer to deal a fourth community card face up, the fourth community card being visible to the dealer and each player;

requiring the dealer to deal a second player card to each player, the second player card being visible to each player and the dealer;

requiring each player to wager a third bet in order to continue participation in the card game;

requiring the dealer to deal a second dealer card, the second dealer card being concealed from the dealer and each player;

requiring the dealer to deal a fifth community card, the fifth community card being visible to the dealer and to each player;

exposing the first dealer card and the second dealer card to permit determination of which of all the participants and the dealer in the card game possesses the highest ranked winning five card poker hand composed of the two cards dealt to each participant and the dealer and the five community cards; and awarding the participant or the dealer with the highest ranked winning five card poker hand a first portion of the bets placed during the card game.

16. The method of playing a card game of claim 15, further comprising the step of randomly determining an order in which each player receives the first and second player card.

17. The method of playing a card game of claim 16, further comprising the step of awarding proceeds of all bets to the dealer when each player has failed to wager a third bet.

18. The method of playing a card game of claim 17, further comprising the step of permitting a player to wager a side bet.

19. The method of playing a card game of claim 18, further comprising the step of forbidding the dealer from retiring from the card game prior to completion of the card game.

* * * * *